US006808077B2

(12) United States Patent
McConnell

(10) Patent No.: US 6,808,077 B2
(45) Date of Patent: Oct. 26, 2004

(54) PORTABLE TOOL ORGANIZER AND APPARATUS

(75) Inventor: Garett McConnell, 5185 Oakwood Ct., Commerce Township, MI (US) 48382

(73) Assignee: Garett McConnell, Commerce Township, MI (US)

( * ) Notice: Subject to any disclaimer, the term of this patent is extended or adjusted under 35 U.S.C. 154(b) by 0 days.

(21) Appl. No.: 10/449,210

(22) Filed: May 30, 2003

(65) Prior Publication Data

US 2003/0192839 A1 Oct. 16, 2003

Related U.S. Application Data

(63) Continuation of application No. 09/798,488, filed on Mar. 2, 2001, now Pat. No. 6,595,375.

(51) Int. Cl.[7] ..... A47F 7/00; A47F 5/00
(52) U.S. Cl. ..... 211/70.6; 211/164
(58) Field of Search ..... 211/164, 70.6, 211/1.53, 70, 69; 294/137, 169

(56) References Cited

U.S. PATENT DOCUMENTS 1,830,373 A * 11/1931 Schmidt
3,892,331 A * 7/1975 Beck
3,905,529 A * 9/1975 Leu
4,119,044 A * 10/1978 Hines
4,712,693 A * 12/1987 Striplin ..... 211/164
4,852,748 A * 8/1989 Burgess et al. ..... 211/70.6
5,335,954 A * 8/1994 Holub et al.
5,531,332 A * 7/1996 Monnens ..... 211/164 X
5,730,303 A * 3/1998 Chow ..... 211/70.6
5,752,732 A * 5/1998 Beaton et al. ..... 294/169
6,595,375 B2 * 7/2003 McConnell ..... 211/70.6

* cited by examiner

*Primary Examiner*—Robert W. Gibson, Jr.
(74) *Attorney, Agent, or Firm*—Kaplan & Gilman, LLP

(57) ABSTRACT

A tool organizer and carrying apparatus comprises a rotatable tool mounting assembly having multiple tool receiving surfaces mounted on a frame. The invention preferably comprises a removable base plate to allow for stable placement on a flat surface such as a workbench or shop floor. The frame provides an axis of rotation for the tool mounting assembly to provide a worker fingertip access to tools mounted thereon. Tools such as sockets are retained on multiple tool receiving surfaces with clips, magnets, nuts and bolts and/or other known retention means for easy removal and replacement. The frame is adaptable to mount the organizer on a base or to a workbench, tool chest or the like and further comprises a means for carrying the organizer.

19 Claims, 10 Drawing Sheets

FIG. 2
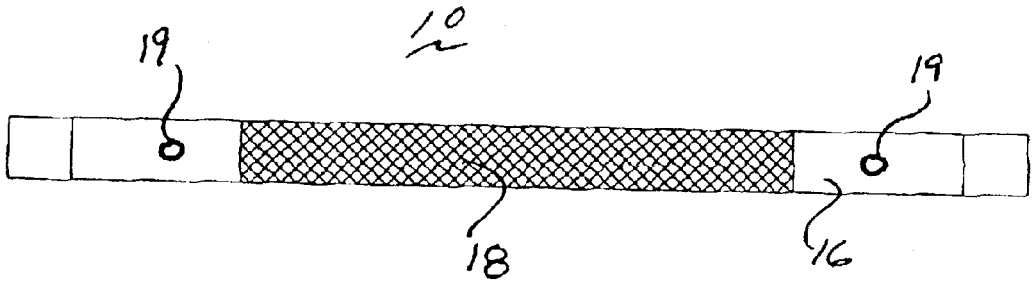
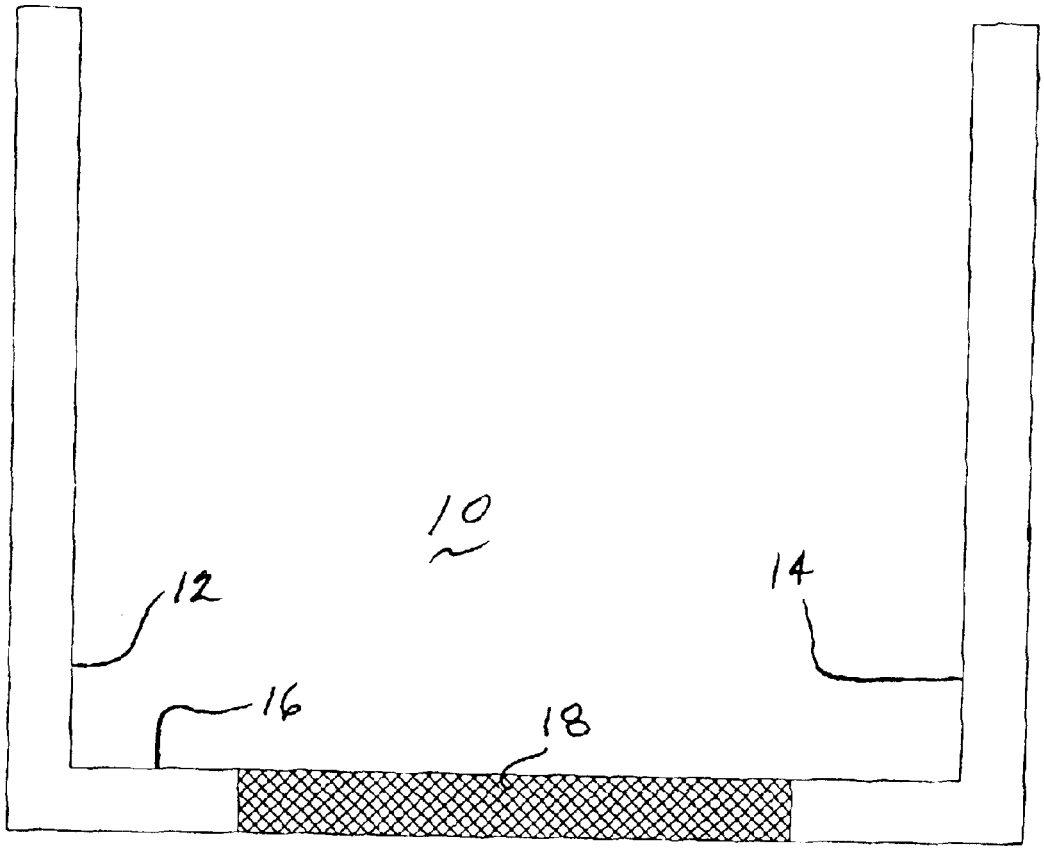
FIG. 3

PORTABLE TOOL ORGANIZER AND APPARATUS

This is a continuation of application Ser. No. 09/798,488 filed Mar. 2, 2001, now U.S. Pat. No. 6,595,375 the entirety of which is hereby incorporated by reference, and claims the benefit of the filing date thereof.

BACKGROUND

This invention relates to the organization of multiple socket sets and various hand tools. The invention provides multiple tool receiving surfaces upon which to mount hand tools and accessories. The invention preferably rotates to provide easy access to tools and accessories affixed thereto.

It is common for mechanics to have more than thirty different socket and/or tool sets. Organizing these tools is therefore of paramount importance.

Until now there have been socket and tool organizers that organize single sets of tools. Examples are described in U.S. Pat. Nos. 4,337,860; 4,410,095; 4,802,580; 4,927,020; 5,855,284; and 6,047,824, all incorporated herein by reference. Socket organizers typically utilize magnets, spring clips or the like to organize sockets in size order, for example, in a linear fashion. With these prior art organizers, multiple tool sets require multiple organizers.

An example of a prior art tool retainer is the magnetic strip. Long magnetic strips are often secured to workbenches or roll carts commonly found in repair shops. The magnetic strips are typically used to hold sockets and various hand tools such as ratchets, screwdrivers and wrenches and provide the mechanic easy identification and access. Typically multiple sets are stored flat in a toolbox. Various difficulties arise when mechanics try to use multiple sets. Namely, visibility and access can become a problem as multiple sets are stacked and placed on top of one another. Another issue associated with these products is movement of multiple sets, i.e., each set required will have to be obtained individually and brought to the workplace. Organization of multiple sets becomes difficult as different socket sets are moved to different locations as they are used.

Although these prior art tool retainers and organizers are useful and provide a convenient means of organizing and storing tools, there has remained a need for a tool and socket organizer to handle a larger quantity of tools and multiple socket sets.

SUMMARY OF INVENTION

The present invention provides a means to store, carry and organize a large number of sockets and tools. The present invention organizes prior art socket and tool retention devices by providing multiple mounting surfaces for multiple tools, tool sets and tool organizers on a single portable organizer. The present invention has multiple tool receiving faces to organize tools by category if desired. For example, ¼" sockets can be mounted on one face and ⅜" drive sockets on another face. The present invention is adaptable so that it can be mounted to a roll cart, workbench, shop vise or placed on surfaces such as a shop floor. The present invention facilitates movement of multiple socket sets since multiple sets are contained on a single organizer. The rotatable assembly of the organizer provides easy fingertip access to any socket or tool mounted thereon. The tool receiving faces can accept various tool retention means known in the art such as but not limited to socket clips and rails, spring clips, various magnetic retainer systems and the like. The tool receiving faces allow for customized placement of tools to suit individuals' needs. Additionally, changing the placement or configuration of the tool retention means can alter the appearance of the organizer. The tool retention means can be rearranged on the tool receiving faces to provide custom organization for each user. This allows the user to arrange their most commonly used tools in the most convenient order. The tool organizer places a large number of tools at the user's fingertips for easy access.

The tool organizer keeps tools off of the work surface, leaving more workspace available to the user. In keeping the tools off of the work area, the tools are easier to see and identify, making acquiring tools easier and saving time associated with looking for a hidden tool.

The organizer is preferably rotatably mounted between vertical uprights of a U-shaped frame such as by a rod through the frame and sides of the organizer to provide an, axis of rotation for the organizer.

Alternatively the organizer can be fixedly attached to the frame.

The present tool organizer provides several unique advantages over the prior art.

The present invention provides a means to attach and organize multiple socket sets and tools in an easy to obtain format, eliminating the clutter and disorganization commonly encountered with prior art tool organizers.

The present invention further provides multiple mounting options. In one embodiment the tool organizer is adapted to be bolted to a workbench, wall or roll cart.

The present invention still further provides a base for securing to the frame to provide stable placement of the invention on any flat surface such as a shop floor or a workbench.

The present invention still further provides a means for carrying the organizer wherein the frame provides a handle used to carry the organizer and its tools to different workplaces. In a most preferred embodiment the section of frame employed as a handle is knurled.

In another aspect, the present invention further provides a means for holding the rotatable tool retention device in a plurality of stationary positions.

BRIEF DESCRIPTION OF THE DRAWINGS

FIG. 2 is a top view of the frame/handle of the present invention.

FIG. 3 is a front view of the frame/handle of the present invention.

DETAILED DESCRIPTION OF THE PREFERRED EMBODIMENT

The present invention will be better understood by the following detailed description of the invention and with reference to the drawings.

Figure 1:
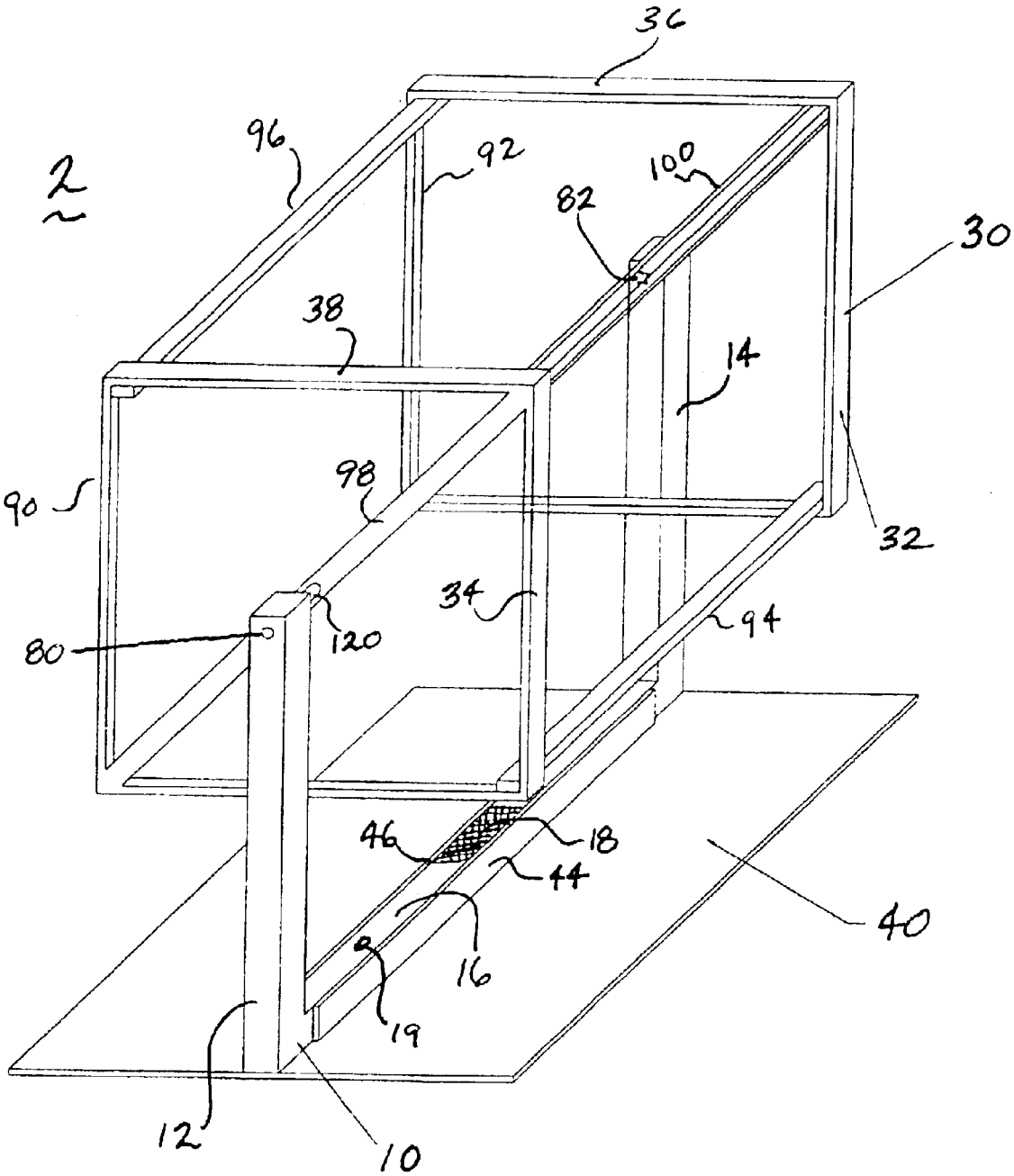
FIG. 1 is a perspective view of one embodiment of the present invention.

Now referring to FIG. 1, the organizer 2 comprises frame 10 and tool mounting assembly 30.

Now referring to FIGS. 1, 2 and 3, frame 10 typically comprises uprights 12 and 14 and base 16. Frame 10 can comprise any suitable material such as wood, metal, or fiberglass but is preferably formed of tube steel. Base 16 may further comprise openings 19 formed therein to facilitate mounting the base to a workbench, floor, wall or the like by means of bolting or the like.

Now referring to FIGS. 2 and 3, base 16 preferably further comprises knurling 18 to facilitate carrying. The length of uprights 12 and 14 are preferably approximately equivalent and should be of sufficient length to allow rotation of the tool mounting assembly 30 with an additional five to six inches to allow for socket and tool clearance.

Figure 10:
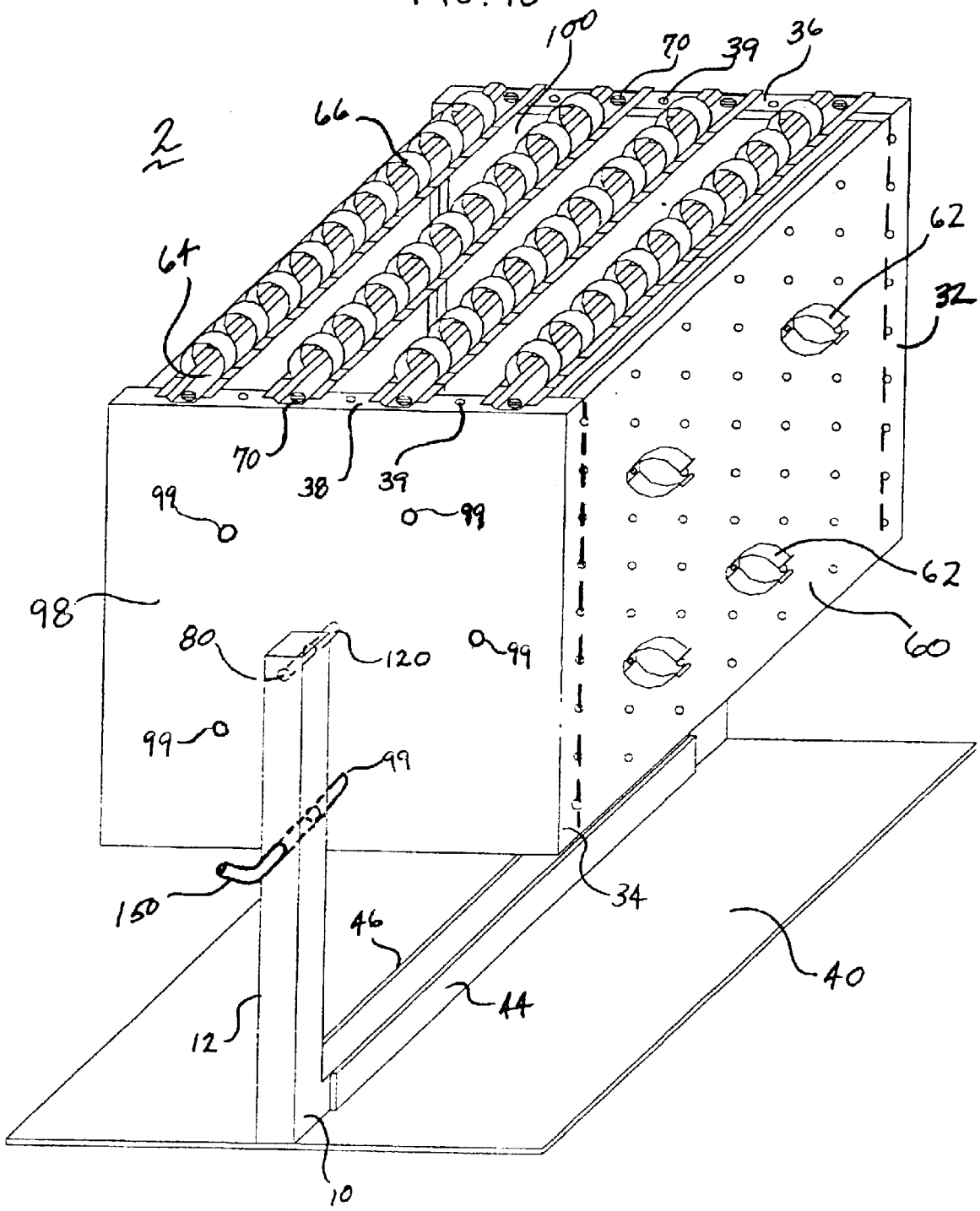
FIG. 10 is a perspective of the preferred embodiment of the invention as shown in FIG. 4.

Now referring to FIG. 1, tool mounting assembly 30 comprises an elongated member comprising two ends 90 and 92 connected by at least one longitudinal piece 94 said ends 90 and 92 each further comprising engagement means 98 and 100 for connecting tool mounting assembly 30 to frame 10 such as but not limited to cross members which may be fastened to said frame 10 by any suitable means known to one skilled in the art such as but not limited to by a bolt, screw or the like. Engagement means 98 and 100 may comprise cross members as shown in FIGS. 1 and 4–7 or may comprise a sheet of material as shown in FIG. 10. In a preferred embodiment the means for connecting tool mounting assembly 30 to frame 10 are cross members 98 and 100 which further comprise a means for providing an axis of rotation for the tool mounting assembly 30 which is rotatably mounted between the uprights 12 and 14 of frame 10.

Figure 4:
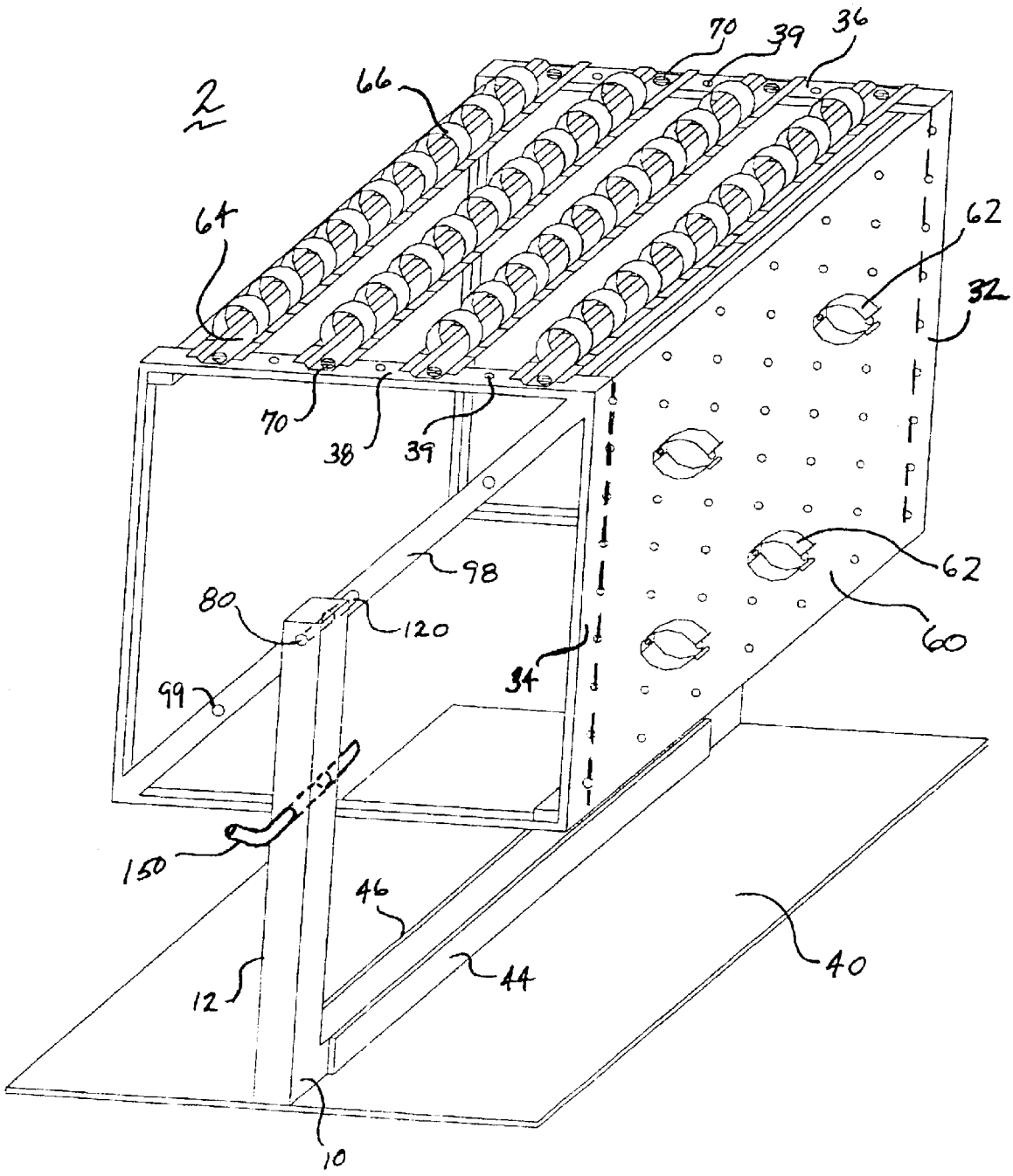
FIG. 4 is a perspective view of a preferred embodiment of the present invention.

Tool mounting assembly 30 further comprises multiple tool receiving faces 32, 34, 36 and 38 for accommodating tools, tool retention means and/or tool organizers. For example, now referring to FIG. 4, the tool receiving faces 32 and 34 (shown in ghost), accommodate a plate 60 to which tool retention means comprising clips 62 such as but not limited to spring clips are mounted. The clips 62 in turn secure other tools such as ratchets, wrenches or screwdrivers. The tool retention means such as clips 62 are attached to the tool receiving faces by any means known in the art such as but not limited to magnetic attachment, nut and bolt attachment, rivets, spring clips and the like. In another example, as best seen in FIG. 4, tool receiving faces 36 and 38 further comprise openings 39 formed therein and accommodate strips 64 comprising retaining clips 66. Strips 64 are attached to receiving faces 36 and 38 by screws 70 received in opening 39. Openings 39 may be formed in any of the tool receiving faces 32, 34, 36 and 38. The embodiments shown in FIGS. 1 and 4 are not meant to limit the invention but are merely exemplary. For example, the tool receiving faces shown are 32, 34, 36 and 38 which are visible because of the perspective view. Not visible from FIGS. 1 and 4 are further tool receiving faces hidden from view. It is obvious to one skilled in the art that the remaining faces of the four-sided embodiment shown in FIGS. 1 and 4 comprise tool receiving faces.

Figure 5:
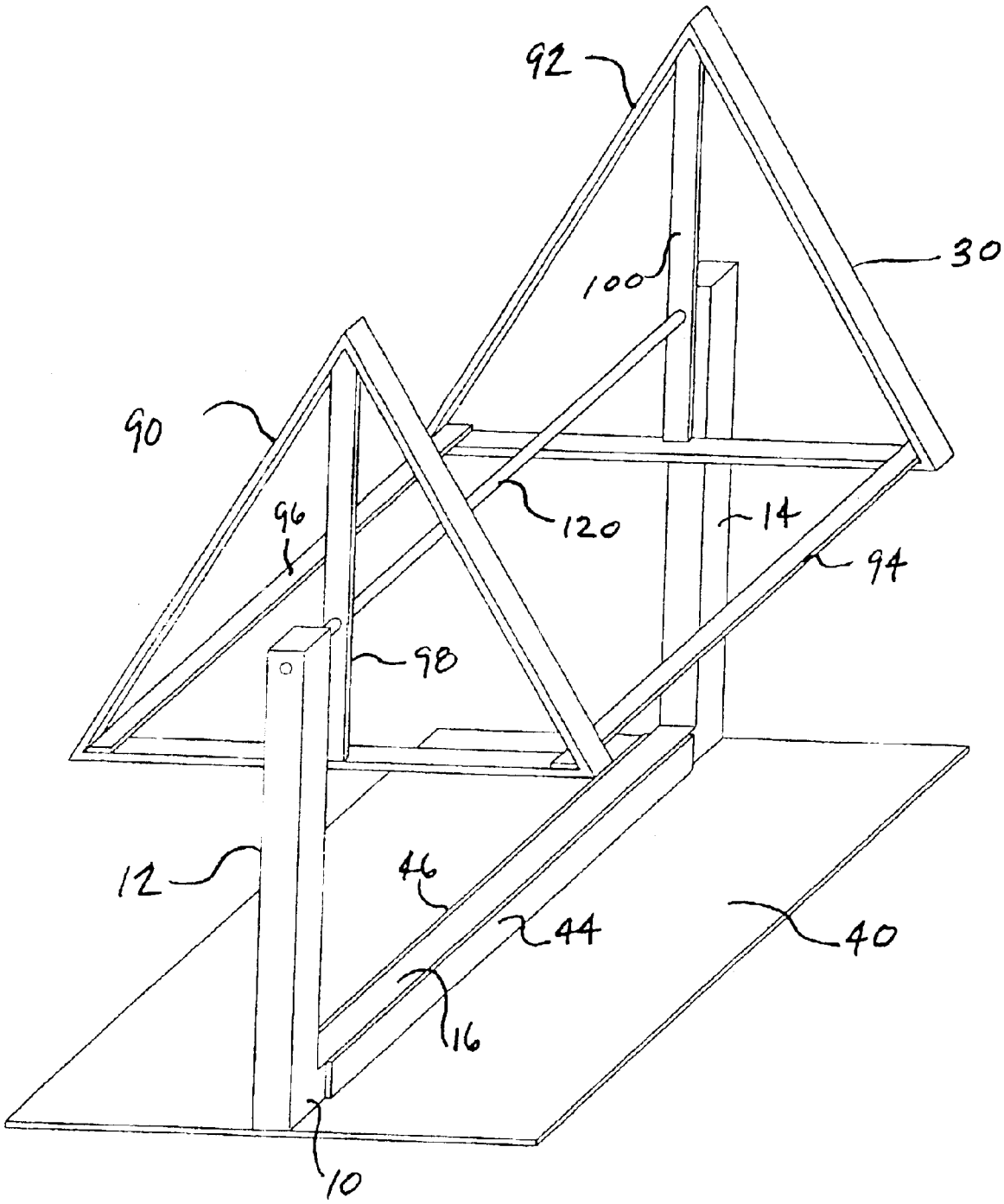
FIG. 5 is a perspective view of an alternate embodiment of the present invention.
Figure 6:
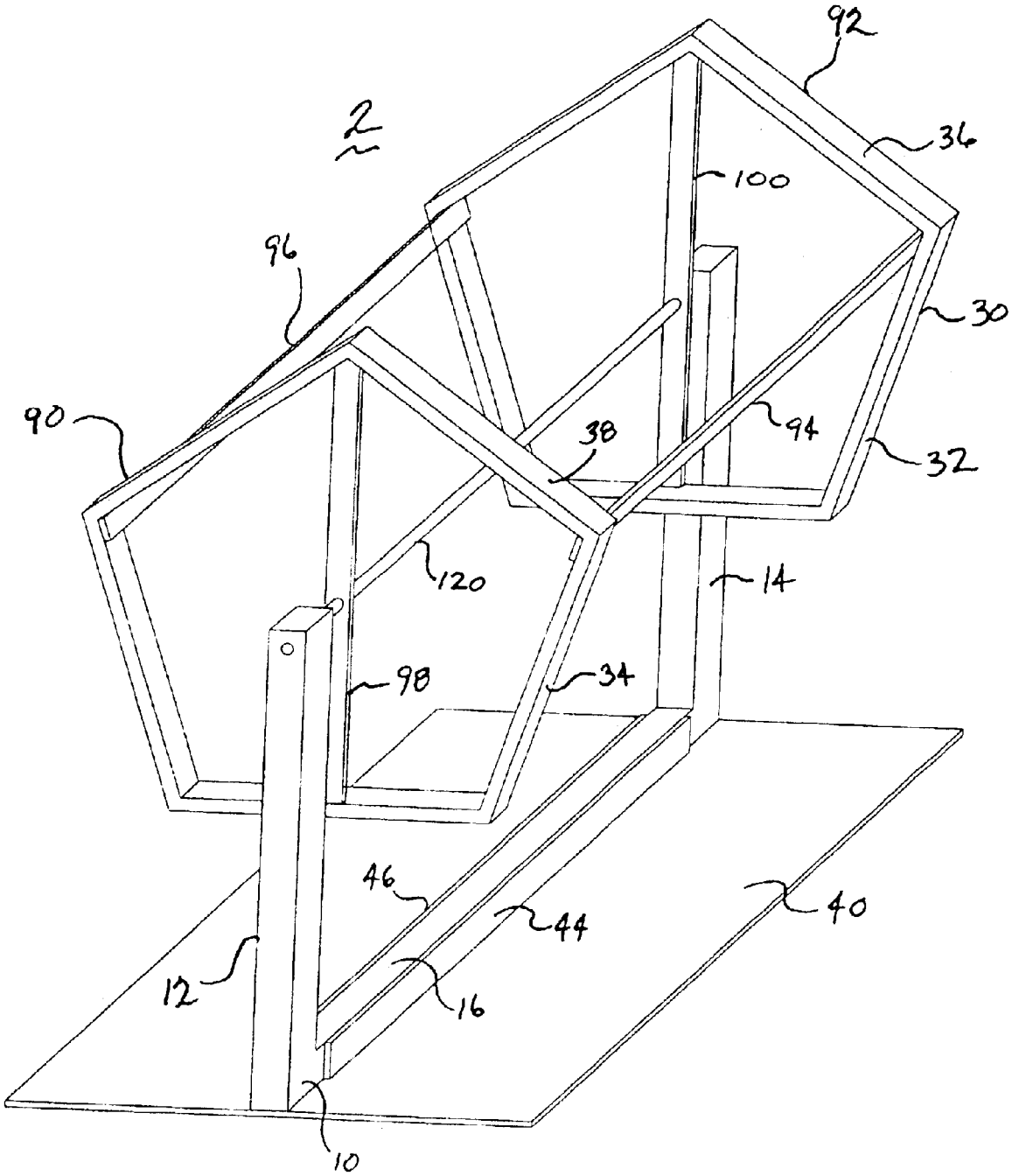
FIG. 6 is a perspective view of an alternate preferred embodiment of the present invention.
Figure 7:
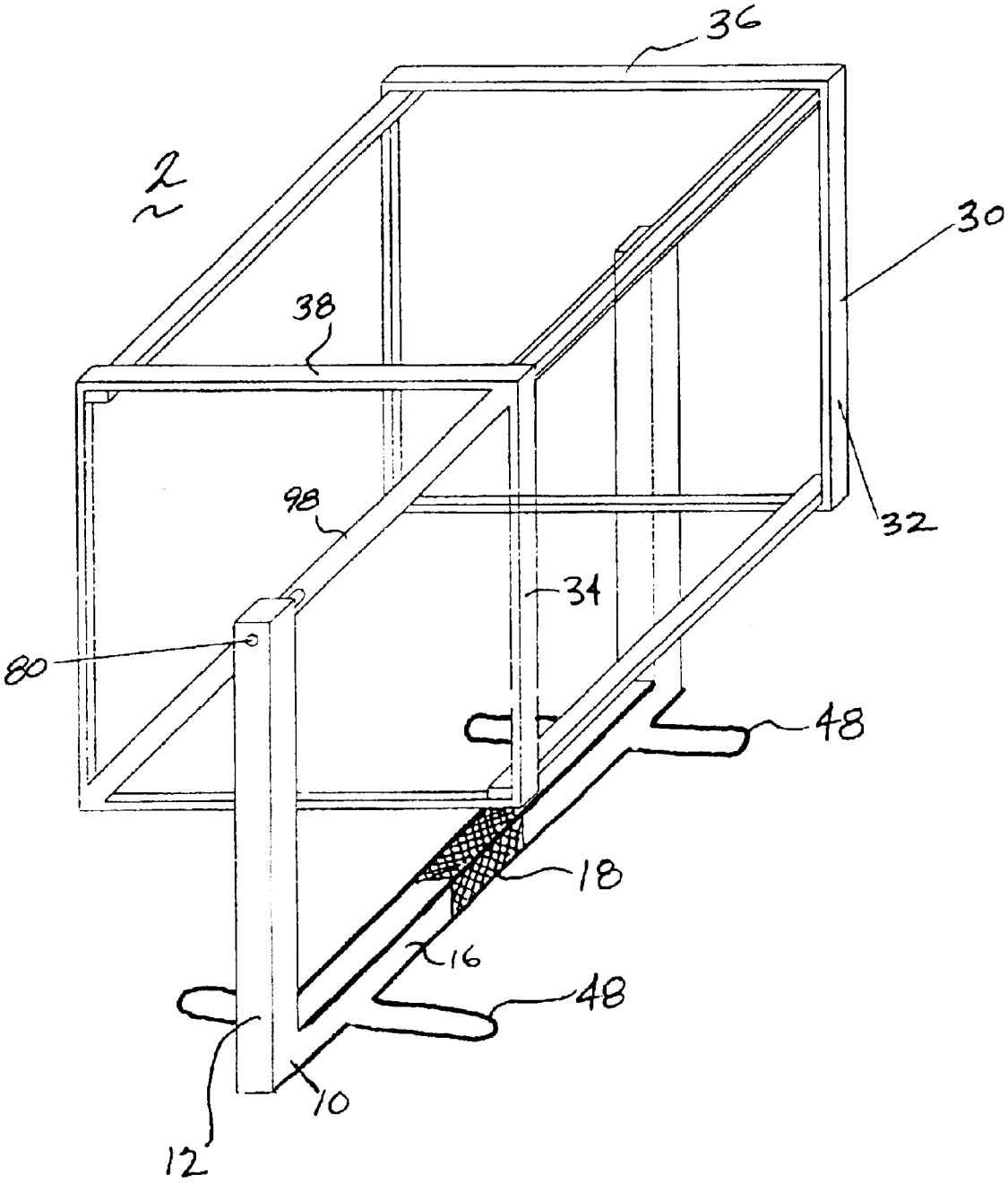
FIG. 7 is a perspective view of a most preferred embodiment of the present invention.

Now referring to FIGS. 1 and 4–7, tool mounting assembly 30 preferably is rotatable within uprights 12 and 14. The means for mounting said tool mounting assembly 30 to frame 10 is by any known rotatable mounting means such as but not limited to a rotation pin 120 extending from either end of said tool mounting assembly 30 into openings 80 and 82 formed in said uprights 12 and 14. As best seen in FIGS. 5–7, pin 120 may extend through tool mounting assembly 30. Alternatively, pins (not shown) may be mounted on said uprights 12 and 14 and extend into openings formed in the ends of said tool mounting assembly 30. Such pins may be spring loaded to accommodate removal and installation of said tool mounting assembly 30 onto said frame 10.

As best seen in FIGS. 5 and 6, in a most preferred embodiment the rotatable attachment in the present invention is effected by a pin 120 rotatably engaged to the frame 10 parallel to the base 16 of the frame 10. The pin 120 provides a rotation axis for the tool mounting assembly 30.

Figure 8:
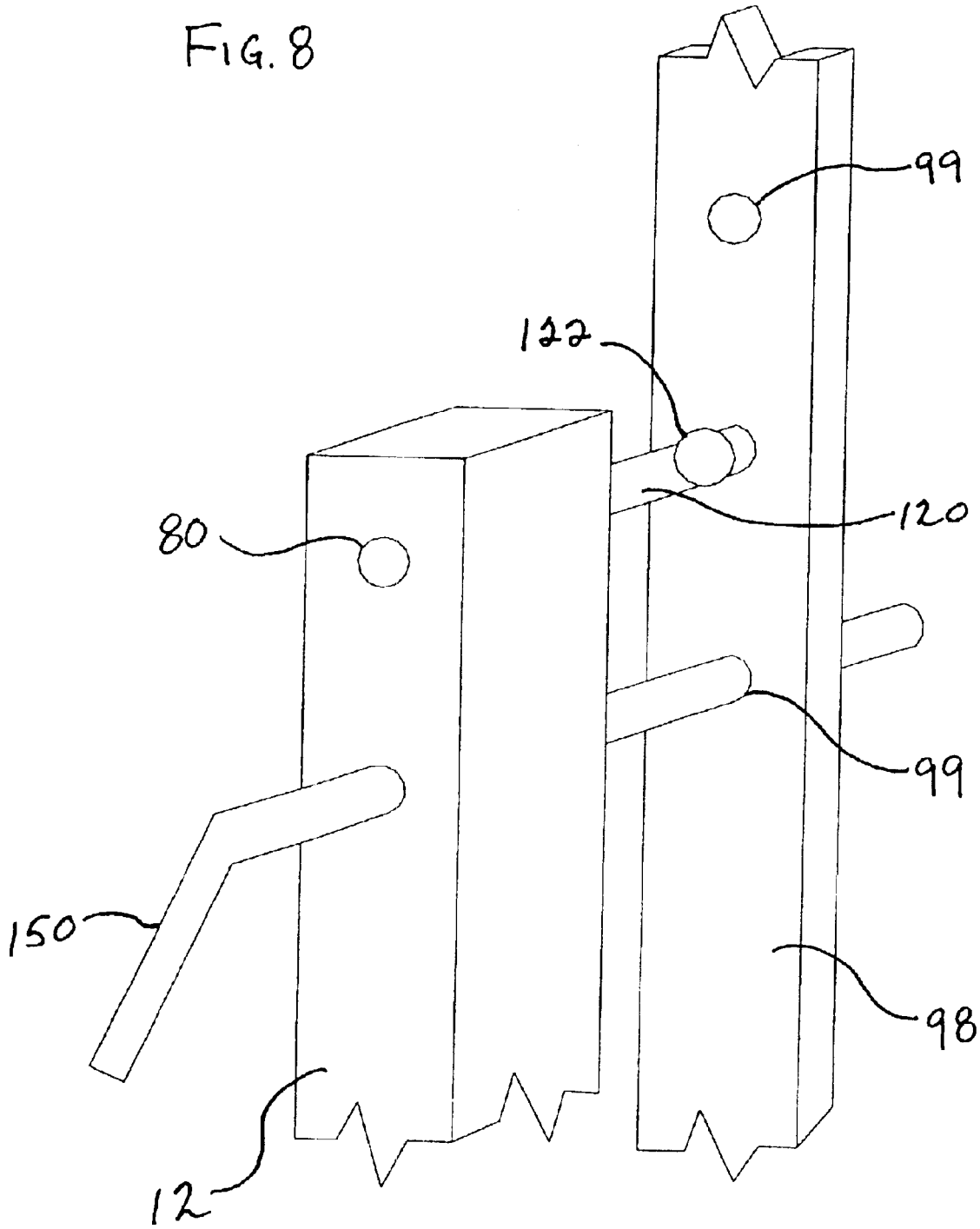
FIG. 8 is a perspective view of a detail of a preferred embodiment of the invention shown in FIG. 4.
Figure 9:
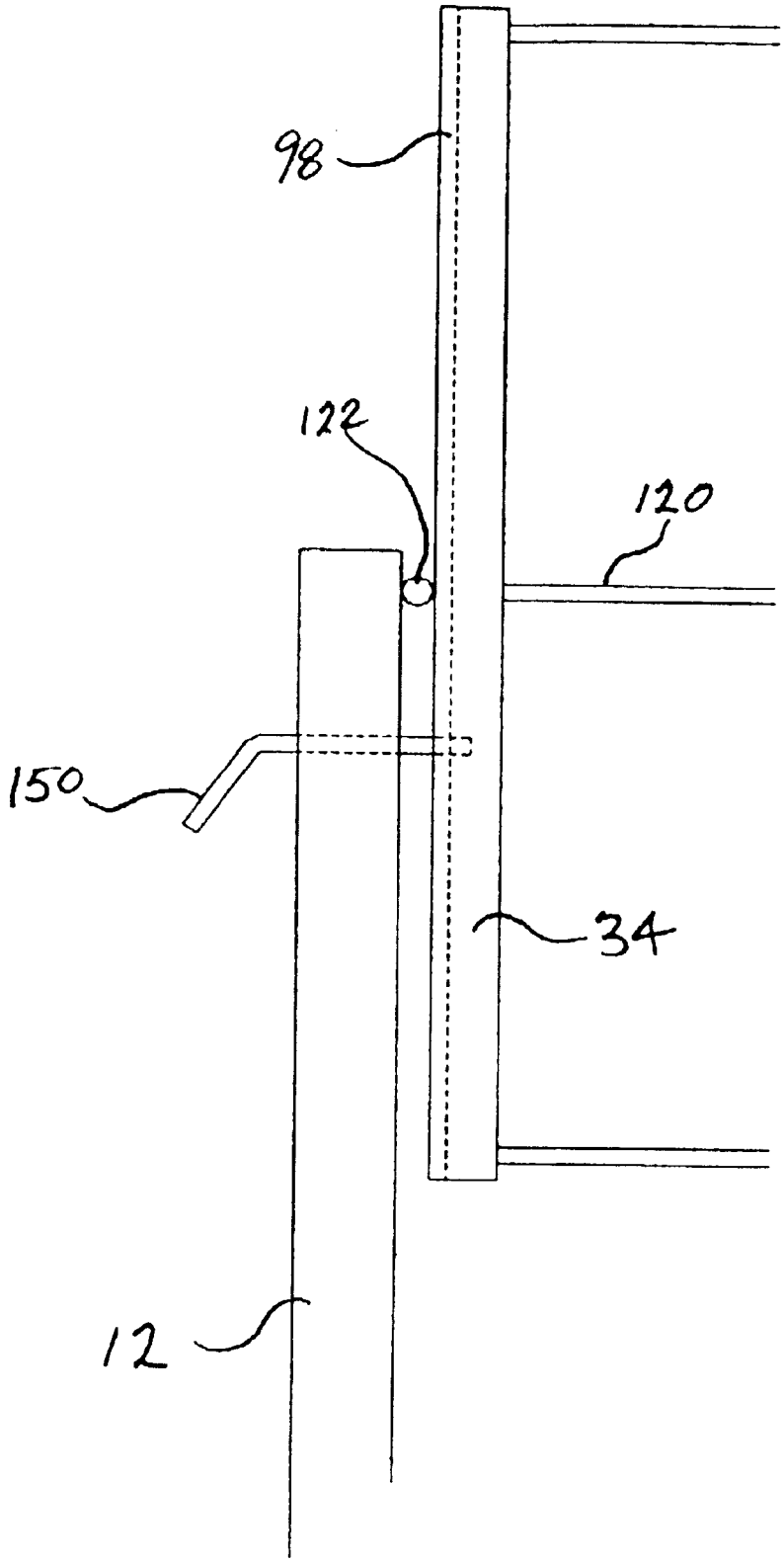
FIG. 9 is a front view of the preferred embodiment of the invention as shown in FIG. 4.

In another embodiment, as best seen in FIGS. 8 and 9, the rotation pin 120 preferably comprises a retaining means for impeding side to side movement of the tool mounting assembly 30 on frame 10. Suitable retaining means are depressions 122 formed on pin 120 outside of said tool mounting assembly 30, retaining rings, cotter pins and the like as will be obvious to one skilled in the art.

Now referring to FIGS. 4, 8 and 9, the present invention may further comprise a means for holding the rotatable tool mounting assembly in a static position such as but not limited to anti-rotation pin 150 that is manually releasable for releasing the rotatable tool mounting assembly 30 to freely rotate and engagable such as to opening 99 formed in cross member 98 for locking the tool mounting assembly 30 to impede rotation. As best seen in FIG. 10, it is contemplated that engagement means 98 may have multiple openings 99 formed therein for accommodating anti-rotation pin 150.

Figure 1A:
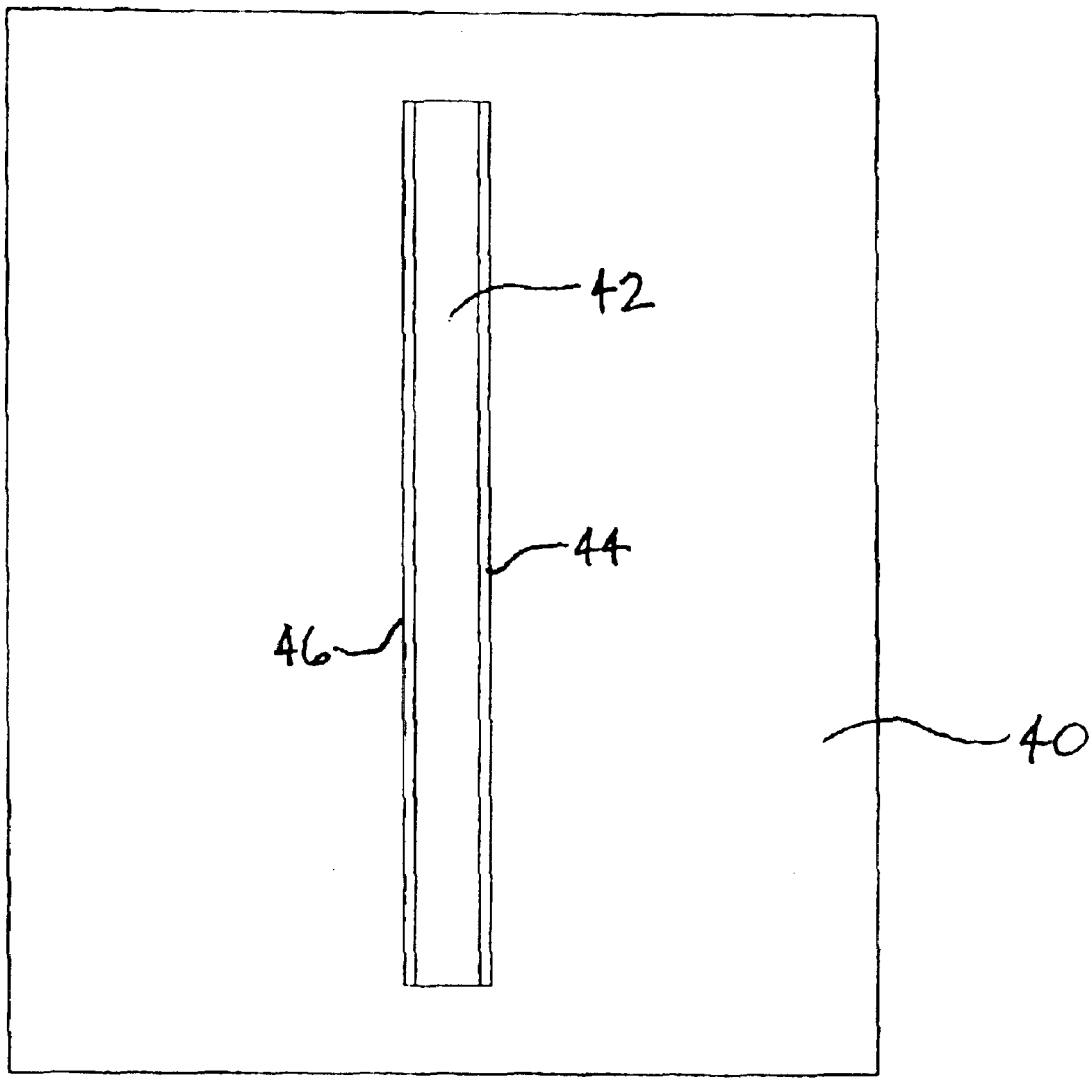
FIG. 1*a* is a top plan view of the base plate of one aspect of the present invention.

Now referring to FIGS. 1 and 1*a*, base plate 40 provides a means to stand said organizer in an upright position if said organizer is not attached to a floor, a bench or a work piece such as but not limited to by bolting, vise grip, C-clamp or the like. Base plate 40 typically comprises a flat plate forming a stable surface, said plate having on one side a retaining means 42 for removably retaining said frame 10. As best seen in FIGS. 1, 4, 5 and 6, the retaining means 42 for removably accepting said frame 10 may comprise any means known in the art such as but not limited to a channel comprising two parallel strips 44 and 46 extending perpendicularly from said plate sufficiently spaced to securably accept base 16 of frame 10. Base plate 40 may further comprise tube steel. Though not shown, retaining means 42 may comprise latches, clips or other means well known in the art.

Now referring to FIG. 7, in a most preferred embodiment frame 10 and base plate 40 are integral, base plate 40 comprising feet 48. As shown in FIGS. 1 and 7, knurling 18 may be provided on base 16 to facilitate carrying the tool mounting assembly 30.

Now referring to FIGS. 5 and 6, tool mounting assembly 30 can comprise several embodiments. Now referring to the embodiment in FIG. 5, the embodiment in tool mounting assembly 30 comprises an elongated member comprising two substantially identical three dimensional substantially geometrically shaped (in FIG. 5, triangles) ends 90 and 92 connected by longitudinal pieces 94 and 96, said ends having cross members 98 and 100, respectively, disposed therein and an axis of rotation formed by the rotatable attachment of the tool mounting assembly 30 to the frame 10 disposed in said cross members 98 and 100.

Now referring to FIG. 6, in another embodiment tool mounting assembly 30 is elongated and comprises pentagonal ends 90 and 92. As is obvious to one skilled in the art, the tool mounting assembly can have end pieces that are polygonal or circular. Other geometric forms such as hexagons, etc. are contemplated by the present invention, it being obvious to one skilled in the art that the form of the invention is dictated in part by the items to be mounted. The frame 10 is optimally deep enough to allow rotation of the tool mounting assembly 30 with an additional 5–6 inches to allow for socket and tool clearance.

The dimension of the present invention can vary from about 6 inches to about 30 inches in length, about 6 inches to about 30 inches in width and about 6 inches to about 30 inches in height. In a most preferred embodiment, the present invention is 11 inches in length, 9 inches in width and 14.5 inches in height and is fabricated of steel.

While the invention has been described by reference to specific embodiments, this is for illustrative purposes only. Various modifications to the above invention will become apparent to those skilled in the art, all of which are intended to fall within the spirit and scope of the present invention. All patents and publications referred to herein are hereby incorporated by reference.

What is claimed is:

1. A portable tool organizer comprising a tool mounting assembly and a frame, said tool mounting assembly comprising an elongated member having at least a first end and a second end and at least one tool receiving face mounted between said ends;

said tool receiving face comprising at least one hand tool retention means, said retention means adapted to securably and releasably retain at least one hand tool said tool retention means selected from the group consisting of a snrina clip, magnetic clip, socket tray, socket rail, socket clip, wrench rack, socket holder, and magnetic part tray;

said frame comprising uprights forming a substantially U-shaped frame, wherein said tool mounting assembly is mounted within said uprights of said U-shaped frame.

2. The invention of claim 1 wherein said tool mounting assembly is rotatably mounted between said uprights of said frame.

3. The invention of claim 1 wherein said ends comprise substantially identical three dimensional substantially geometric structures.

4. The invention of claim 1 wherein said elongated member comprises at least two tool receiving faces.

5. The invention of claim 1 further comprising a means for holding said tool mounting assembly in a fixed position relative to said frame.

6. The invention of claim 5 wherein said means for holding said tool mounting assembly in a fixed position is a pin disposed in said frame extendible to impede rotation of said tool mounting assembly.

7. The invention of claim 1 wherein said tool mounting assembly further comprises a first three dimensional geometric structure radially disposed on said first end and a second three dimensional geometric structure radially disposed on said second end, said elongated member extending to an axis of rotation of each of said geometric structures, wherein said elongated member is rotatably engaged in opposing openings formed in said uprights of said frame.

8. A portable tool organizer comprising a tool mounting assembly and a frame, said tool mounting assembly comprising an elongated member having at least a first end and a second end and at least one tool receiving face mounted between said ends;

said tool receiving face comprising at least one hand tool retention means, said retention means adapted to securably and releasably retain at least one hand tool, said tool retention means comprising at least one clip disposed on said tool receiving face, said frame comprising uprights forming a substantially U-shaped frame, wherein said tool mounting assembly is mounted within said uprights of said U-shaped frame.

9. The invention of claim 3 wherein at least one of said ends is substantially polygonal.

10. The invention of claim 3 wherein at least one of said ends is substantially circular.

11. A portable tool organizer comprising a tool mounting assembly comprising at least two substantially identical three dimensional substantially geometrically shaped ends each of said ends further comprising a central axis of rotation, an elongated member having a first and second end extending at said first end to said axis of rotation of one of said geometrically shaped ends and at said second end to said axis of rotation of the other of said geometrically shaped ends; a substantially U-shaped frame adapted to support said tool mounting assembly rotatably disposed within said frame; and at least one tool retention means disposed on said tool mounting assembly, said tool retention means selected from the group consisting of a spring clip, magnetic clip, socket tray, socket rail, socket clip, wrench rack, socket holder, and magnetic part tray.

12. A portable tool organizer comprising a tool mounting assembly and a frame, said tool mounting assembly comprising an elongated member having a first end and a second end and at least one tool receiving face mounted between said ends;

at least one hand tool retention means extending from said tool receiving face said retention means adapted to securably and releasably retain at least one hand tool said tool retention means comnrising at least one socket rail;

said frame comprising a base having substantially parallel uprights extending substantially perpendicular from said base;

wherein said tool mounting assembly is mounted between said uprights of said frame.

13. The invention of claim 12 wherein said tool mounting assembly is rotatably mounted between said uprights of said frame.

14. The invention of claim 12 wherein said base is adapted to serve as a handle.

15. The invention of claim 12 wherein said ends comprise substantially identical three-dimensional substantially geometric structures.

16. The invention of claim 12 wherein said elongated member comprises at least two tool receiving faces.

17. A portable tool organizer comprising a tool mounting assembly and a frame, said tool mounting assembly comprising an elongated member having a first end and a second end and at least one tool receiving face mounted between said ends;

at least one hand tool retention means extending from said tool receiving face said retention means adapted to securably and releasably retain at least one hand tool said tool retention means comprising at least one clip;

said frame comprising a base having substantially parallel uprights extending substantially perpendicular from said base;

wherein said tool mounting assembly is mounted between said uprights of said frame.

18. A portable tool organizer comprising a tool mounting assembly and a frame, said tool mounting assembly comprising an elongated member having at least a first end and a second end and at least one tool receiving face mounted between said ends;

said tool receiving face comprising at least one hand tool retention means, said retention means adapted to securably and releasably retain at least one hand tool, said tool receiving face comprising at least one opening for receiving said tool retention means;

said frame comprising uprights forming a substantially U-shaped frame, wherein said tool mounting assembly is mounted within said uprights of said U-shaped frame.

19. A portable tool organizer comprising a tool mounting assembly and a frame, said tool mounting assembly comprising an elongated member having at least a first end and a second end and at least one tool receiving face mounted between said ends;

said tool receiving face comprising at least one hand tool retention means, said retention means adapted to securably and releasably retain at least one hand tool, said tool receiving face comorisina a magnetic component for magnetically adhering said retention means to said tool receiving face;

said frame comprising uprights forming a substantially U-shaped frame, wherein said tool mounting assembly is mounted within said uprights of said U-shaped frame.

* * * * *